US009015042B2

(12) United States Patent
Valin et al.

(10) Patent No.: US 9,015,042 B2
(45) Date of Patent: Apr. 21, 2015

(54) METHODS AND SYSTEMS FOR AVOIDING PARTIAL COLLAPSE IN MULTI-BLOCK AUDIO CODING

(75) Inventors: Jean-Marc Valin, Montreal (CA); Timothy B. Terriberry, Mountain View, CA (US)

(73) Assignee: Xiph.org Foundation

( * ) Notice: Subject to any disclaimer, the term of this patent is extended or adjusted under 35 U.S.C. 154(b) by 272 days.

(21) Appl. No.: 13/414,368

(22) Filed: Mar. 7, 2012

(65) Prior Publication Data

US 2012/0232908 A1 Sep. 13, 2012

Related U.S. Application Data

(60) Provisional application No. 61/450,041, filed on Mar. 7, 2011.

(51) Int. Cl.

| | |
|---|---|
| ***G10L 21/00*** | (2013.01) |
| ***G10L 19/022*** | (2013.01) |
| *G10L 19/02* | (2013.01) |
| *G10L 19/028* | (2013.01) |
| *G10L 19/038* | (2013.01) |
| *G10L 19/26* | (2013.01) |

(52) U.S. Cl.

CPC ..... *G10L 19/022* (2013.01); *G10L 19/0212* (2013.01); *G10L 19/028* (2013.01); *G10L 19/038* (2013.01); *G10L 19/26* (2013.01)

(58) Field of Classification Search

CPC ..... G10L 19/028

See application file for complete search history.

(56) References Cited

U.S. PATENT DOCUMENTS

| | | | |
|---|---|---|---|
| 5,079,547 | A | 1/1992 | Fuchigama et al. |
| 5,778,339 | A | 7/1998 | Sonohara et al. |
| 5,845,241 | A | 12/1998 | Owechko |
| 5,960,388 | A | 9/1999 | Nishiguchi et al. |
| 5,983,172 | A | 11/1999 | Takashima et al. |
| 6,018,707 | A | 1/2000 | Nishiguchi et al. |
| 6,064,954 | A | 5/2000 | Cohen et al. |
| 6,463,097 | B1 | 10/2002 | Held et al. |
| 6,567,777 | B1 | 5/2003 | Chatterjee |
| 6,934,676 | B2 | 8/2005 | Wang et al. |
| 6,993,477 | B1 | 1/2006 | Goyal |
| 7,242,976 | B2 | 7/2007 | Minato |

(Continued)

OTHER PUBLICATIONS

Lee, GunWoo, et al. "Quality Improvement of Very Low Bit Rate HE-AAC Using Linear Prediction Module." Audio Engineering Society Convention 125. Audio Engineering Society, 2008.*

(Continued)

*Primary Examiner* — Brian Albertalli

(74) *Attorney, Agent, or Firm* — Dergosits & Noah LLP; Todd A. Noah

(57) ABSTRACT

Embodiments are described of a multi-block coding scheme for an audio signal to prevent partial collapse conditions from causing pre-echo compression artifacts. An audio codec includes a segmentation component partitioning the audio signal into a plurality of tiles, wherein each tile comprises data from a particular segment of time and a particular set of frequencies of the audio signal; a band energy component determining an energy value for each tile corresponding to a signal component in a respective tile; an encoder flag tracking component marking a tile as not collapsed or collapsed based on the energy value in that tile; and a decoder flag tracking component filling all tiles marked as collapsed with pseudo-random noise at an estimated energy level.

20 Claims, 5 Drawing Sheets

(56) References Cited

U.S. PATENT DOCUMENTS

| | | | | |
|---|---|---|---|---|
| 7,275,036 | B2 | 9/2007 | Geiger et al. | |
| 7,343,287 | B2 | 3/2008 | Geiger et al. | |
| 7,447,631 | B2 * | 11/2008 | Truman et al. | 704/230 |
| 7,454,330 | B1 | 11/2008 | Nishiguchi et al. | |
| 7,483,836 | B2 * | 1/2009 | Taori et al. | 704/500 |
| 7,583,804 | B2 * | 9/2009 | Suzuki et al. | 381/22 |
| 7,630,882 | B2 * | 12/2009 | Mehrotra et al. | 704/205 |
| 7,761,290 | B2 * | 7/2010 | Koishida et al. | 704/222 |
| 7,979,271 | B2 | 7/2011 | Bessette | |
| 8,195,730 | B2 | 6/2012 | Geiger et al. | |
| 8,364,471 | B2 * | 1/2013 | Yoon et al. | 704/206 |
| 8,463,599 | B2 * | 6/2013 | Ramabadran et al. | 704/205 |
| 8,494,863 | B2 * | 7/2013 | Biswas et al. | 704/500 |
| 8,554,818 | B2 | 10/2013 | Zhang et al. | |
| 8,620,674 | B2 | 12/2013 | Thumpudi et al. | |
| 2005/0216262 | A1 | 9/2005 | Fejzo | |
| 2006/0031064 | A1 | 2/2006 | Liljeryd et al. | |
| 2007/0016405 | A1 | 1/2007 | Mehrotra et al. | |
| 2007/0040710 | A1 | 2/2007 | Tomic | |
| 2007/0063877 | A1 | 3/2007 | Shmunk et al. | |
| 2007/0211804 | A1 | 9/2007 | Haupt et al. | |
| 2007/0282603 | A1 | 12/2007 | Bessette | |
| 2008/0010064 | A1 | 1/2008 | Takeuchi et al. | |
| 2008/0031463 | A1 | 2/2008 | Davis | |
| 2008/0033731 | A1 | 2/2008 | Vinton et al. | |
| 2008/0126104 | A1 | 5/2008 | Seefeldt et al. | |
| 2008/0140393 | A1 | 6/2008 | Kim et al. | |
| 2010/0023336 | A1 | 1/2010 | Shmunk | |
| 2010/0286991 | A1 | 11/2010 | Hedelin et al. | |
| 2011/0035214 | A1 | 2/2011 | Morii | |
| 2011/0173012 | A1 * | 7/2011 | Rettelbach et al. | 704/500 |
| 2011/0178795 | A1 * | 7/2011 | Bayer et al. | 704/205 |
| 2011/0264454 | A1 * | 10/2011 | Ullberg et al. | 704/500 |
| 2012/0029924 | A1 | 2/2012 | Duni et al. | |
| 2012/0029925 | A1 | 2/2012 | Duni et al. | |
| 2013/0117028 | A1 | 5/2013 | Kim | |
| 2013/0218577 | A1 * | 8/2013 | Taleb et al. | 704/500 |

OTHER PUBLICATIONS

International Searching Authority, International Search Report and Written Opinion May 30, 2012 (PCT/US12/28124).

International Searching Authority, International Search Report and Written Opinion Jun. 4, 2012 (PCT/US12/28114).

International Searching Authority, International Search Report and Written Opinion Jun. 6, 2012 (PCT/US12/28120).

International Preliminary Report on Patentability dated Sep. 19, 2013 in PCT Application No. PCT/US2012/028114.

International Preliminary Report on Patentability dated Sep. 19, 2013 in PCT Application No. PCT/US2012/028120.

International Preliminary Report on Patentability dated Sep. 19, 2013 in PCT Application No. PCT/US2012/028124.

International Searching Authority, International Search Report and Written Opinion Feb. 2, 2012 (PCT/US11/52026).

Valin et al. "A full-bandwidth audio codec with low complexity and very low delay." Proc. EUSIPCO, 2009.

Valin et al. "A high-quality speech and audio codec with less than 10-ms delay." Audio, Speech, and Language Processing, IEEE Transactions on 18.1 (2010): 58-67.

Valin et al. "Constrained-Energy Lapped Transform (CELT) Codec", IETF Internet Draft, Jul. 4, 2009.

Kruger et al. "On Logarithmic spherical vector quantization." Information Theory and Its Applications, 2008. ISITA 2008. International Symposium on. IEEE, 2008.

* cited by examiner

DECODER 200

METHODS AND SYSTEMS FOR AVOIDING PARTIAL COLLAPSE IN MULTI-BLOCK AUDIO CODING

CROSS-REFERENCE TO RELATED APPLICATIONS

This application claims priority to provisional U.S. Provisional Patent Application No. 61/450,041, filed on Mar. 7, 2011 and entitled "Method and System for Avoiding Partial Collapse in Multi-Block Audio Coding," which is incorporated herein in its entirety.

COPYRIGHT NOTICE

A portion of the disclosure of this patent document including any priority documents contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

One or more implementations relate generally to digital communications, and more specifically to eliminating quantization distortion in audio codecs.

INCORPORATION BY REFERENCE

The present application incorporates by reference U.S. Patent Application No. 61/384,154, which is assigned to the assignees of the present application.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches.

The transmission and storage of computer data increasingly relies on the use of codecs (coder-decoders) to compress/decompress digital media files to reduce the file sizes to manageable sizes to optimize transmission bandwidth and memory use. Transform coding is a common type of data compression for data that reduces signal bandwidth through the elimination of certain information in the signal. Sub-band coding is a type of transform coding that breaks a signal into a number of different frequency bands and encodes each one independently as a first step in data compression for audio and video signals. Transform coding is typically lossy in that the output is of lower quality than the original input. Many present compressors fail to remedy problems associated with compression artifacts, which are noticeable distortion effects caused by the application of lossy data compression, such as pre-echo, warbling, or ringing in audio signals, or ghost images in video data.

Many sub-band audio codecs, such as MP3, can partition a frame of audio data into multiple (possibly overlapping) blocks in order to more accurately represent transient signals, which are signals that change abruptly in time. Such partitioning helps eliminate distortions caused by quantization that would otherwise spread over the entire frame, creating an artifact known as "pre-echo." Pre-echo and similar effects are caused when distortion artifacts are audible before the temporal event that caused them. One solution to eliminate pre-echo artifacts is to partition the audio frames into a large number of relatively small blocks. When the bit rate is limited, however, all of the bits may be spent coding the transient (at least in some portions of the spectrum). This leaves no bits available for the surrounding blocks, and causes a "partial collapse" wherein none of the energy in one or more regions of the spectrum in one or more blocks is coded. This partial collapse leaves a hole in the band that can be just as audible as any pre-echo artifact. This problem is especially acute in codecs that utilize small blocks and encode multiple small blocks (e.g., up to eight blocks) at one time.

What is needed, therefore, is a system to detect and fill coding holes created by collapsed blocks that are not encoded due to lack of available bits, so as to avoid any partial collapse artifacts, while attempting to ensure that no pre-echo artifacts are introduced.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Embodiments are generally directed to systems and methods for coding digital audio that include mechanisms for detecting and filling coding holes caused by partial collapse situations in which no bits are available to code frame portions surrounding a portion containing a transient signal. The collapsed frame portions (or "tiles") are filled with pseudorandom noise that is randomly generated by the system or derived from neighboring blocks to represent background noise.

Any of the embodiments described herein may be used alone or together with one another in any combination. The one or more implementations encompassed within this specification may also include embodiments that are only partially mentioned or alluded to or are not mentioned or alluded to at all in this brief summary or in the abstract. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

Aspects of the one or more embodiments described herein may be implemented on one or more computers or processor-based devices executing software instructions. The computers may be networked in a peer-to-peer or other distributed computer network arrangement (e.g., client-server), and may be included as part of an audio and/or video processing and playback system.

Figure 1:
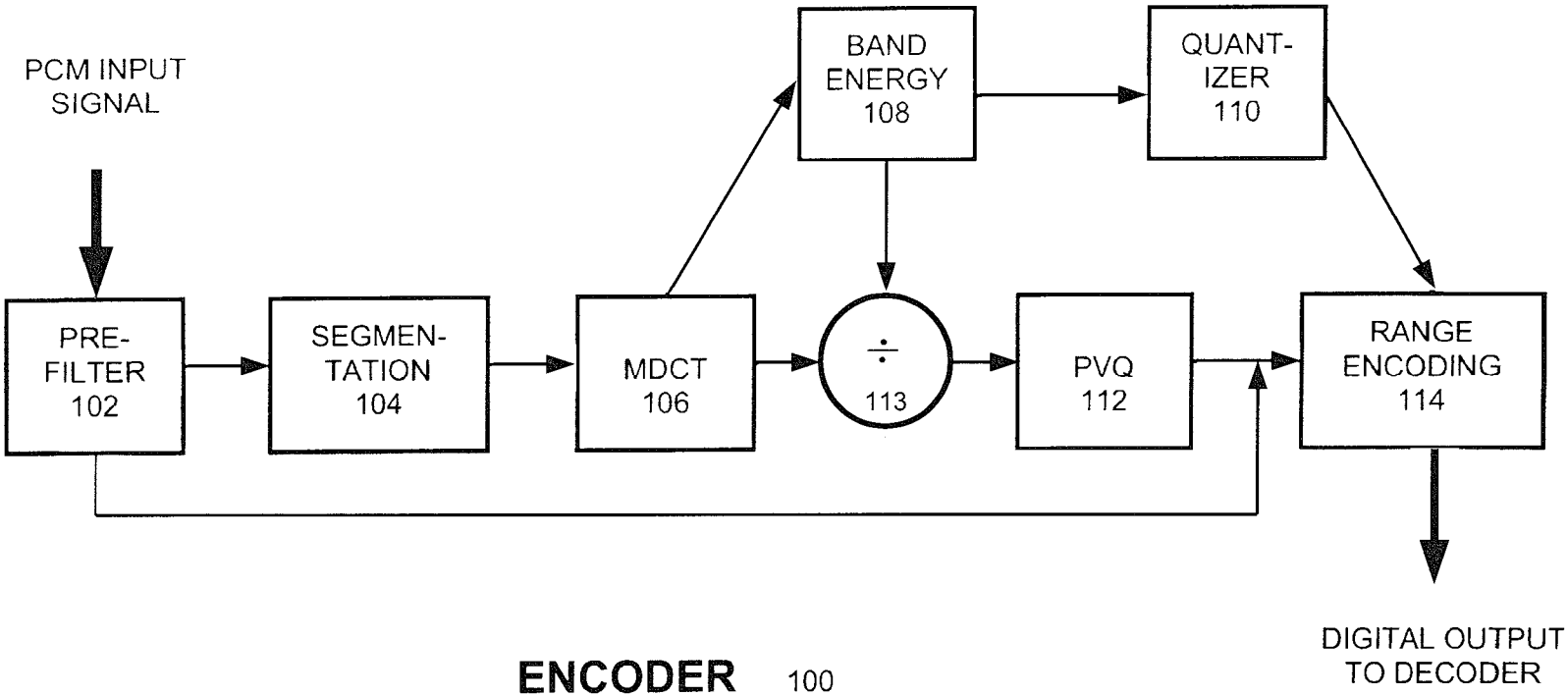
FIG. 1 is a diagram of an encoder circuit for use in a multi-block audio coding system, under an embodiment.

Embodiments are directed to a multi-block audio coding scheme implemented in a codec (coder-decoder) system. FIG. 1 is a block diagram of an encoder circuit for use in a multi-block audio coding system, under an embodiment. The encoder 100 is a transform codec circuit based on the modified discrete cosine transform (MDCT) and code-excited linear prediction (CELP) algorithms using a codebook for excitation in the frequency domain. The input signal is a pulse-code modulated (PCM) signal that is input to a pre-filter stage 102. The PCM coded input signal is segmented into a number of relatively small overlapping blocks by segmentation component 104. The block-segmented signal is input to the MDCT function 106 and transformed to frequency coefficients through an MDCT function. Different block sizes can be selected depending on application requirements and constraints. For example, short block sizes allow for low latency, but may cause a decrease in frequency resolution. The frequency coefficients are grouped to resemble the critical bands of the human auditory system. The entire amount of energy of each group is analyzed in band energy component 108, and the values quantized in quantizer 110 for data reduction. The quantized energy values are compressed through prediction by transmitting only the difference to the predicted values (delta encoding). The unquantized band energy values are removed from the raw DCT coefficients (normalization) in function 113. The coefficients of the resulting residual signal (the so-called "band shape") are coded by Pyramid Vector Quantization (PVQ) function 112. PVQ is a form of spherical vector quantization using the lattice points of a pyramidal shape in multidimensional space as the quantizer codebook for quickly and efficiently quantizing Laplacian-like data, such as data generated by transforms or subband filters. This encoding process produces code words of fixed (predictable) length, which in turn enables robustness against bit errors and removes any need for entropy encoding. The output of the encoder is coded into a single bitstream by a range encoder 114. The bitstream output from the range encoder 114 is then transmitted to the decoder circuit.

In an embodiment, and in connection with the PVQ function 112, the encoder 100 uses a technique known as band folding, which delivers a similar effect to the spectral band replication by reusing coefficients of lower bands for higher bands, while also reducing algorithmic delay and computational complexity.

Figure 2:
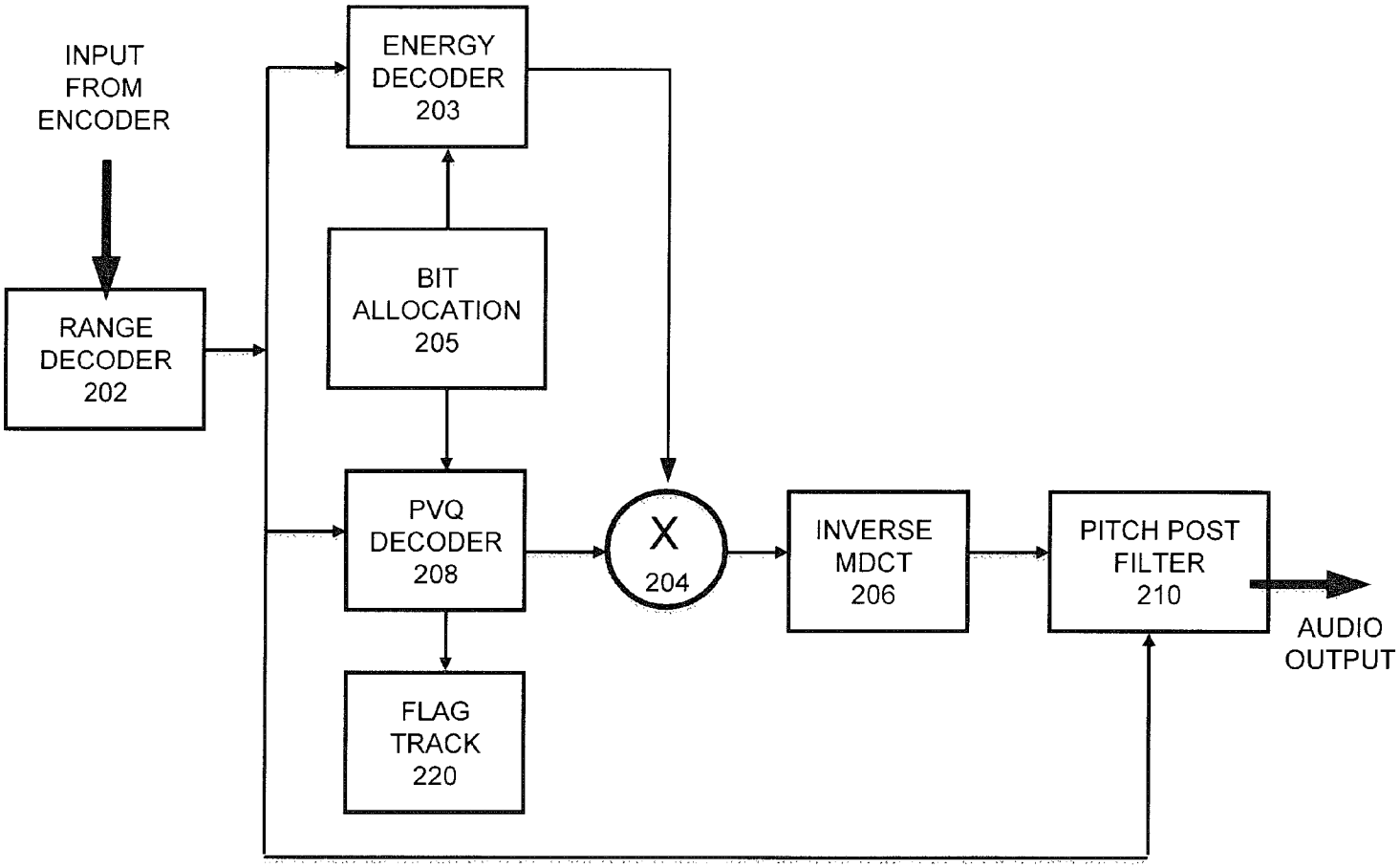
FIG. 2 is a diagram of a decoder circuit for use in a multi-block audio coding system, under an embodiment.

FIG. 2 is a diagram of a decoder circuit for use in a multi-block audio coding system, under an embodiment. The decoder 200 receives the encoded data from the encoder and processes the input signal through a range decoder 202. From the range decoder 202, the signal is passed through an energy decoder 203 and a PVQ decoder 208, and to pitch post filter 210. The values from PVQ decoder 208 are multiplied to the band shape coefficients by function 204, and then transformed back to PCM data through inverse MDCT function 206. The individual blocks may be rejoined using weighted overlap-add (WOLA) in folding block. Many parameters are not explicitly coded, but instead are reconstructed using the same functions as the encoder. The decoded signal is then processed through a pitch post filter 210 and output to an audio output circuit, such as audio speaker(s). In the embodiment of FIG. 2, a bit allocation function 205 provides bit allocation data to the energy decoder 203 and the PVQ decoder 208. A flag tracking component 220 receives data from the PVQ decoder 208 and controls the flagging of collapsed tiles and the injection of pseudorandom noise, as required.

In an embodiment, the codec represented by FIG. 1 and FIG. 2 may be an audio codec, such as the CELT (Constrained Energy Lapped Transform) codec developed by the Xiph.Org Foundation. It should be noted, however, that any similar codec might be used.

For the embodiment of FIGS. 1 and 2, an input audio signal is mapped from the time domain into a set of frequency domain coefficients, using a transform function. This function may be either a transform with a fixed resolution across all frequencies, such as the Modified Discrete Cosine Transform (MDCT), or one with variable time-frequency (TF) resolution. An example of a variable time-frequency resolution scheme is described in U.S. Patent Application No. 61/384,154.

After transformation to the frequency domain, the coefficients are grouped by frequency into a number of bands, whose size may vary to match properties of the human ear. This accounts for psycho acoustic effects associated with audio signal processing. Each band may further group coefficients into tiles, where each tile contains coefficients from distinct periods of time. In general, a block encompasses data from a particular segment of time over all frequencies, and a band encompasses data from a particular set of frequencies over all the blocks in the frame. A tile comprises data from a particular segment of time and a particular set of frequencies.

In an embodiment, the basis functions corresponding to coefficients within an individual tile decay to zero or nearly zero outside of the time period that a particular tile corresponds to, in order to minimize their magnitude outside this period to avoid leakage and reduce the occurrence of pre-echo artifacts. The tiles are then quantized, coded, and transmitted to a decoder. As part of the codebook used in the quantization process, different portions of the band may be coded explicitly. Other portions may be produced by a linear combination of the content of one or more prior bands (possibly requiring TF-resolution changes, such as described in U.S. Patent App. No. 61/384,154) if the number of tiles in the source band is not the same as the number of tiles in the band to which it is being copied. In an embodiment, certain portions of a band may be filled with pseudorandom noise.

Figure 3:
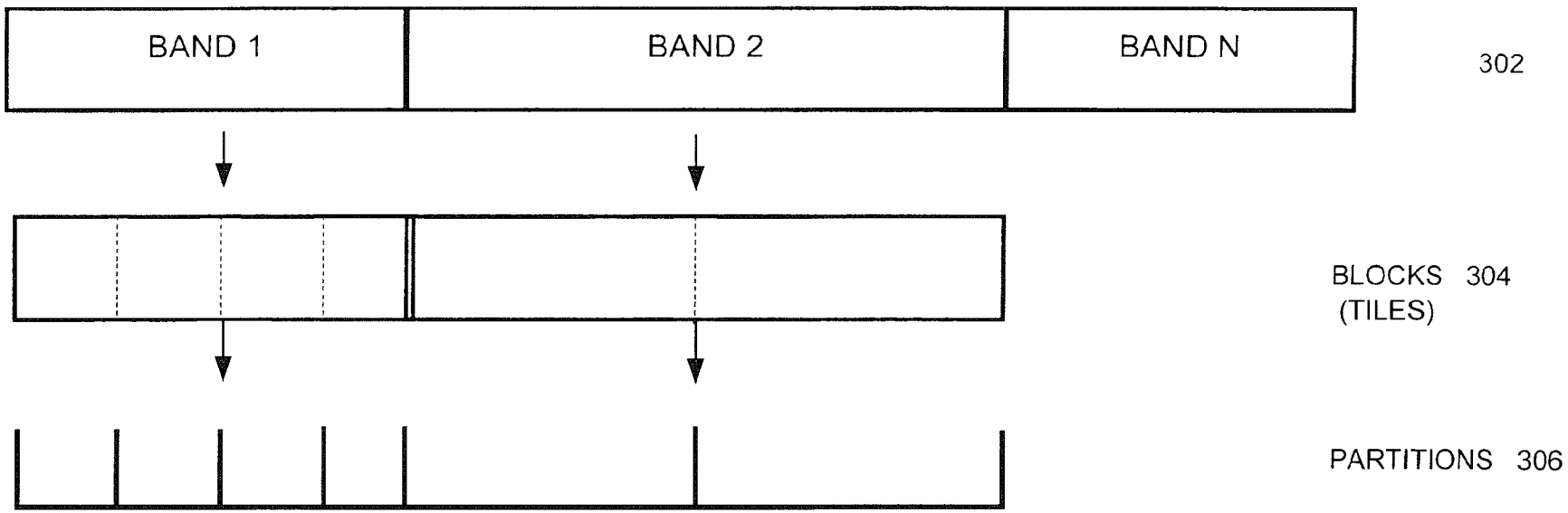
FIG. 3 is a diagram that illustrates the partitioning of audio bands into blocks and partitions for use with a multi-block coding system, under an embodiment.

In an embodiment, the codec processes signals that are organized in relatively small blocks. FIG. 3 is a diagram that illustrates the partitioning of audio bands into blocks and partitions for use with a multi-block coding system, under an embodiment. The audio signal is divided into a number of frames. Each frame is of a set duration, such as 20 milliseconds. For the embodiment of FIG. 3, each frame is divided into eight blocks 304 of duration 2.5 milliseconds each. If variable TF resolution is used, any change in time resolution may change the size of the blocks. When coded, the blocks may be organized into partitions 306. A partition may correspond to a single block, a part of a block, or multiple blocks, or their constituent tiles. Each partition corresponds to a portion of a band at which an independent decision can be made to code it explicitly, use a linear combination of the content of other bands, or fill it with pseudorandom noise at an explicitly coded energy level.

The use of relatively small blocks (or tiles) in the codec may give rise to a problem of partial collapse which is caused when none of the energy in one or more tiles is coded due to bitrate limits that cause all of the bits to be used coding a transient signal. Partial collapse can lead to a hole in a band that is often as audible as a pre-echo artifact. To prevent encoder-decoder mismatch, the decoder and the encoder must both come to the same conclusion about which tiles in which bands have collapsed through the course of band signal processing. Any mismatch can affect the coding of present or future audio frames and makes testing and validation difficult. If all calculations are performed with fixed-point arithmetic, then a decoder can track exactly which tiles are entirely filled with zeros (a "collapse"), although this is an unnecessary limitation to the precision of the signal processing on a machine with fast floating point operations. In addition, even though it is frequently possible for the encoder to skip some of the reconstruction steps the decoder must perform such sample-level tracking would prevent the encoder from skipping these steps.

In an embodiment, the codec maintains one flag per block per band to indicate whether or not a corresponding band has collapsed. In a typical use case, the encoder may segment a single audio frame into eight overlapping blocks and run eight complete MDCT operations, and then partition the output of each of these MDCT operations into 21 bands. In this case, there would be 168 (8×21) tiles, each of which has an associated flag. At the end of the flag tracking process, there is one flag per block per band that indicates whether or not a particular tile has collapsed. This allows the decoder to inject pseudorandom noise using an estimated energy level before it runs the inverse MDCT process to avoid collapse.

The flags are propagated between bands when portions of them are copied to another band, and possibly split or merged during any requisite TF-resolution changes. In general, tracking at the tile level instead of the sample level requires much less computational overhead. Although this process may fail to identify some small number collapses, by following a set of simple flag coding rules, it will not detect a collapse that does not exist. As shown in FIG. 2, the decoder 200 circuit includes a flag-tracking component 220 that generates and maintains the flags that indicate which tiles have collapsed and fills collapsed tiles with pseudorandom noise content.

In an embodiment, the flag tracking component 220 sets a flag for each tile of the frame indicating whether or not the tile is collapsed. The flag tracking component causes the decoder to fill any collapsed tiles with pseudorandom noise if another flag, a feature enable bit, is set to enable filling of the collapsed tiles.

Figure 4:
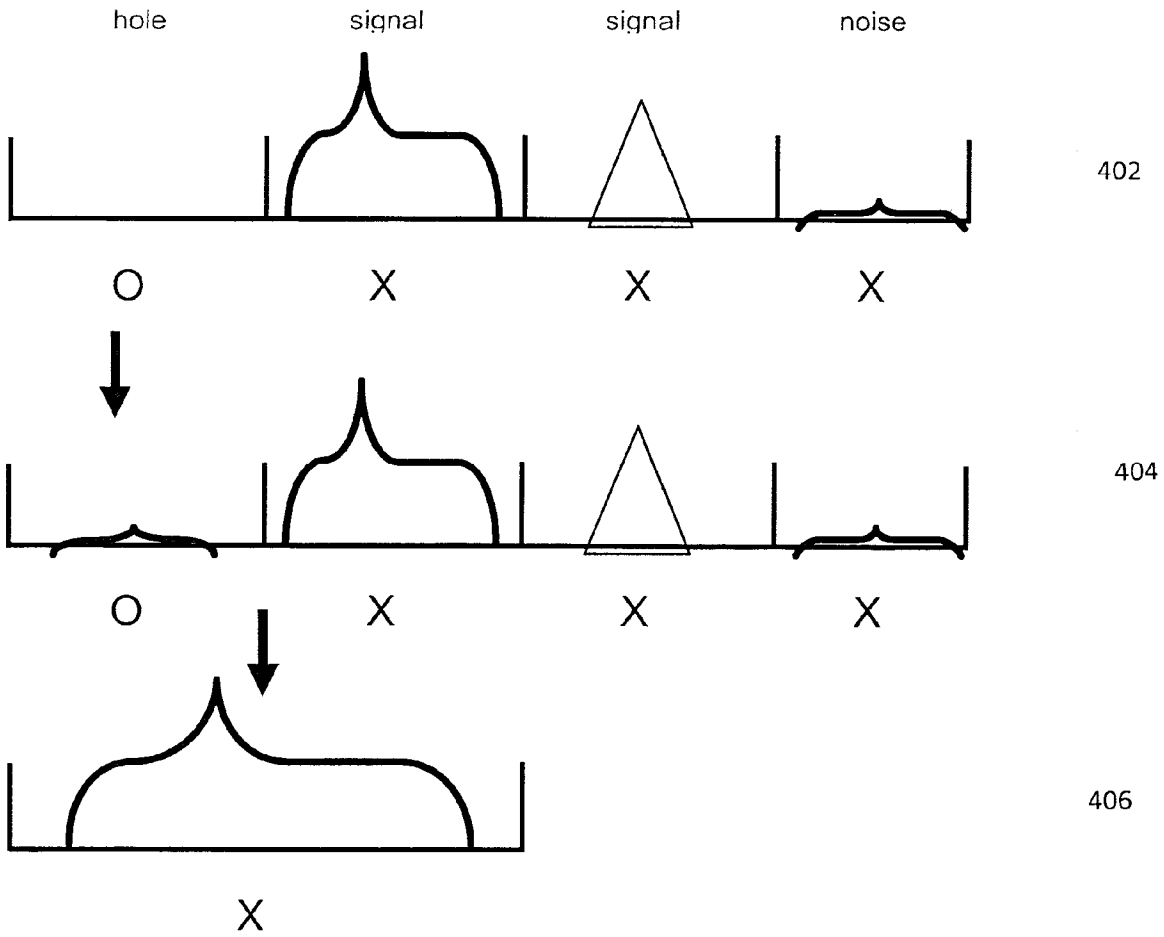
FIG. 4 is a diagram that illustrates the filling of collapsed audio tiles with pseudorandom noise in a multi-block coding system, under an embodiment.

The rules for maintaining these flags are explained with reference to FIG. 4. FIG. 4 is a diagram that illustrates the defining of tile as collapsed/not collapsed and the filling of collapsed audio tiles with pseudorandom noise in a multi-block coding system, under an embodiment. As shown in FIG. 4, each tile that contains a signal is denoted as "not collapsed" and marked with a flag value, X. The signal could represent an explicitly coded portion of a band, a portion filled with a linear combination of the content of other bands, or a portion filled with pseudorandom noise at an explicitly coded energy level. Each tile that has at least one explicitly coded non-zero coefficient in it is marked "not collapsed." For a portion of a band composed of a linear combination of the content of one or more other bands, possibly after one or more TF-resolution changes, the flag for each output tile is set to "not-collapsed" if any of the flags of the corresponding tiles used as input to the linear combination are marked "not collapsed." For a portion of a band filled with pseudorandom noise at an explicitly coded energy level, each corresponding tile covered by that portion is marked "not collapsed."

Any tile that is not marked as non-collapsed is marked "collapsed" and is denoted with a flag value 0.

Under certain conditions, a tile can be explicitly coded and yet still collapse due to insufficient bits. The use of vector quantization (VQ) involves coding a single codeword that represents multiple coefficient values. A given codeword might mean, "among all these coefficients, there is one non-zero value of magnitude A at position X," while another codeword, which requires more bits, might mean, "among all these coefficients, there are two non-zero values, with magnitudes A and B, located at positions X and Y, respectively."

If a codeword spans multiple tiles, but an encoder only has enough bits for the former kind of codeword, then only one tile will have a non-zero coefficient, despite the fact that there is an explicit codeword coding the value of the coefficients in the other tiles (that value being zero). Even if the encoder has enough bits to use the latter kind of codeword, it might choose locations X and Y that are both in the same tile, leaving the other tile zero. The decoder does not know if there really was no energy in those other tiles, or if the encoder just did not have enough bits to use a codeword that would have contained a non-zero value in them.

An encoder may also sometimes signal that there is some energy in a partition, but not actually code any VQ codeword for it. In this situation, the decoder will fill the partition with a linear combination of the content of other bands or with pseudorandom noise. This is possible because the decoder knows how much energy should be present in the partition. If instead the encoder signals that there is no energy in a partition, a decoder does not know if there really was no energy, or if the encoder just did not have enough bits to quantize that energy with sufficient resolution to indicate that it was non-zero.

In an embodiment, a component of the encoder enables the flag tracking feature, and the flag tracking component 220 of the decoder performs the marking of the tiles based solely on other values it has decoded from the bitstream from the encoder. The decoder then fills the "collapsed" marked tiles in order to prevent the zero-coded tile from forming a hole in the frame, which may be perceived as a compression artifact.

In the case of variable TF resolution system, the TF resolution change may either increase the number of tiles by splitting a tile into two or more tiles (increase the time resolution) or decrease the number of tiles by combining two or more tile into a single tile. When the content of a band is subjected to a TF-resolution change that increases the time resolution (increases the number of tiles), then all of output tiles produced from a single input tile copy the same flag as the input tile they were derived from. When the content of a band is subjected to a TF-resolution change that decreases the time resolution (decreases the number of tile), then each output tile is marked "not-collapsed" if any of the input tiles it is derived from were marked "not-collapsed". Thus, as shown in FIG. 4, tile 406, which is a combination of the first two tiles of band 402 is marked as "not collapsed" since at least one of the combined tiles is not collapsed, and it contains the signals present in both tiles.

The rules dictating the setting of the collapse flag are summarized in Table 1 below:

TABLE 1

| CONDITION | FLAG |
|---|---|
| Tile has at least one explicitly coded non-zero coefficient | Marked as Not Collapsed |

TABLE 1-continued

| CONDITION | FLAG |
|---|---|
| Tile contains a linear combination of the content of other bands | Marked as Not Collapsed if any of the corresponding tiles in the other frames are marked Not Collapsed |
| Tile contains pseudorandom noise at an explicitly coded energy level | Marked as Not Collapsed |
| Tile contains none of the above | Marked as Collapsed |
| TF change increases number of tiles | Retain flag setting from original tile |
| TF change decreases number of tiles | Marked as Not Collapsed if any original tile is marked Not Collapsed, or Marked as Collapsed if all original tiles are marked as Collapsed |

As stated above, collapsed tiles are filled with pseudorandom noise at an estimated energy level. As shown in FIG. 4, the collapsed tile in frame 402, which represents a hole in the frame, is filled with a certain amount of noise signal to produce frame 404. In certain cases, such collapsed tiles do not need to be filled with noise, in which case, a single feature enable bit is transmitted by the encoder as side information indicating whether or not collapsed tiles should be filled for the current frame. In general, the filling of a hole with noise may be omitted in some circumstances, such as for frames with only a single block per band, or frames with a short enough duration that collapse is unlikely or short enough to be unobjectionable, whereupon the bit is set to indicate that specific collapsed tile will not be filled.

Assuming that the feature is enabled, each collapsed tile is filled with noise at an energy level that is proportional to an estimate of background noise based on previous frames. In an embodiment, for each collapsed tile in a band, a threshold reconstruction level is computed using the bit allocation in that band and the energy in that band relative to the energy of the same band in one or more prior frames. The use of the bit allocation ensures that the reconstruction level is below an estimate of the quantization noise floor, while the band energy comparisons ensure that the reconstruction level is not louder than previous signal content in that band.

Using the energy from more than one prior frame provides additional safety against introducing pre-echo, since the energy of a band with small blocks (as are typically used to code transients) may fluctuate from frame to frame due to leakage, even if the underlying signal would be relatively stable if a longer analysis window were used.

Using the estimated energy level so derived, the decoder fills the contents of the tile with pseudorandom noise. In the preferred embodiment, this noise is composed of coefficients with the value of ±1, scaled so as to achieve the desired reconstruction level. This avoids the need for a separate renormalization step, and avoids the (otherwise highly unlikely) possibility that the pseudorandom noise is all exactly zero.

Figure 5:
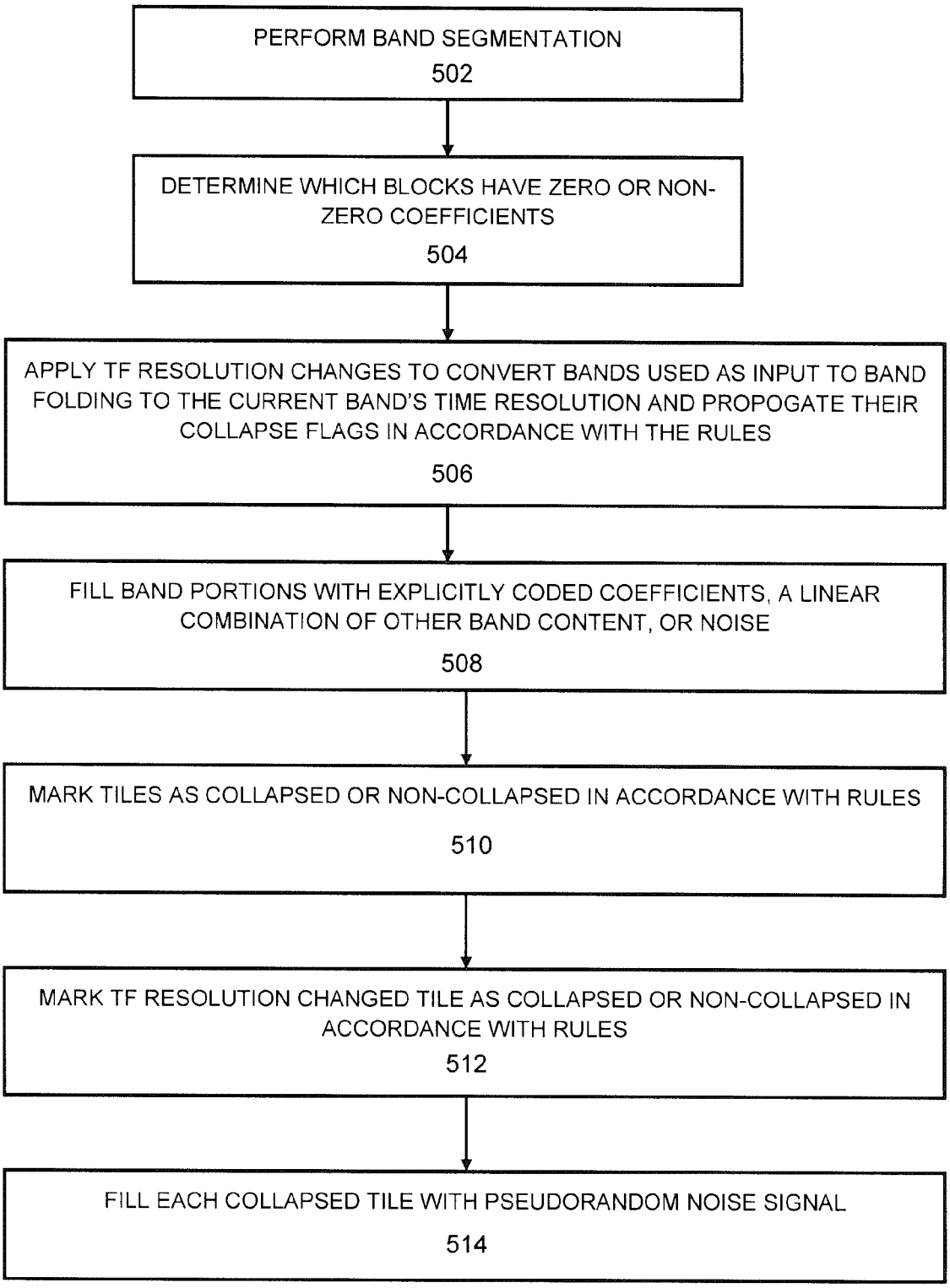
FIG. 5 is a flowchart that illustrates a method of performing multi-block audio coding, under an embodiment.

FIG. 5 is a flowchart that illustrates a method of performing multi-block audio coding incorporating the filling of collapsed tiles, under an embodiment. The process begins with act 502 in which the input audio signal is partitioned into blocks and partitions, as shown in FIG. 3. The process then determines which tiles have zero or non-zero coefficients, act 504.

In act 506, the process applies any applicable TF resolution changes to convert bands used as input to band folding to the current band's time resolution, and propagates their collapse flags in accordance with the rules. The band portions are then filled with explicitly coded coefficients, a linear combination of the content of other bands, or pseudorandom noise at an explicitly coded energy level, act 508. The presence of zero or non-zero coefficients is only used to mark the portions of a band that are explicitly coded, thus in act 510, the process marks tiles as collapsed or non-collapsed in accordance with the rules. As shown in act 512, in the case of variable TF resolution processing, combined tiles are marked as collapsed or non-collapsed in accordance with defined rules, such as those of Table 1. If the enable feature bit is set, each collapsed tile is filled with a noise signal with an estimated energy level that is derived from an estimate based on previous frames, act 514.

The filling of a collapsed tile with pseudorandom noise prevents the tile from constituting a hole in the frame, and thus eliminates or reduces the possibility that the tile will create a compression artifact during the decode process.

In general, any application TF resolution changes performed between the forward MDCT operations in the encoder and the inverse MDCT operations in an embodiment of the decoder do not impact the number of flags to be set for a particular portion of a frame. Such TF-resolution changes do however have an impact on how the flags are computed. For example, assume that a band (denoted Band 6) is coded with increased frequency (reduced time) resolution, e.g., four tiles instead of eight, and these tiles are "explicitly coded," and assume further that only the first of the four tiles has a non-zero coefficient, and thus the four flags are set as follows (where X=Not Collapsed and O=Collapsed):

Band 6:

| | | | |
|---|---|---|---|
| X | ○ | ○ | ○ |

In the decoder a TF-resolution change is applied to map the four tiles that were coded back to the eight tiles that will be used as input to the eight inverse MDCTs. This change increases the time resolution, and so triggers the rule "all of the output tiles produced from a single input tile copy the same flag as the input tile they were derived from." In this case, the result is eight flags, set as follows:

Band 6:

| | | | | | | | |
|---|---|---|---|---|---|---|---|
| X | X | ○ | ○ | ○ | ○ | ○ | ○ |

As a second example, a band (denoted Band 7) is coded with increased time (decreased frequency) resolution, e.g., 16 tiles instead of eight. In particular, assume that we explicitly code that all the energy of the band lies in the first tile, but there are not any bits left over to code the actual coefficients in that tile. Instead, the coefficients from Band 6 are copied. This example, is the "linear combination of the content of one or more other bands" case, and for purposes of illustration—in this case a trivial linear combination.

First, the decoder applies a TF-resolution change to Band 6 so that it has the same time resolution as Band 7. This change increases the time resolution, so it triggers the same rule as before:

Band 6:

| | | | | | | | | | | | | | | | |
|---|---|---|---|---|---|---|---|---|---|---|---|---|---|---|---|
| x | x | x | x | ○ | ○ | ○ | ○ | ○ | ○ | ○ | ○ | ○ | ○ | ○ | ○ |

The coefficients of the first tile are then copied into the first tile of band 7. The rule here is "each output tile is set to 'not-collapsed' if the flag for any of the corresponding tiles used as input to the linear combination are marked 'not-collapsed.'" In this case there is just one tile used as input, the first tile of band 6, so that flag is copied over. The other 15 flags for band 7 are set to "collapsed", as they belong an explicitly coded portion of the band with no non-zero coefficients:

Band 7:

| | | | | | | | | | | | | | | | |
|---|---|---|---|---|---|---|---|---|---|---|---|---|---|---|---|
| x | x | x | x | ○ | ○ | ○ | ○ | ○ | ○ | ○ | ○ | ○ | ○ | ○ | ○ |

Then, as with band 6, a TF-resolution change is applied to map the 16 tiles that were coded back to the eight tiles that will be used as input to the inverse MDCTs. This change decreases the time resolution, and so triggers the rule "each output tile is marked 'not collapsed' if any of the input tiles it is derived from were marked 'not collapsed.'" So the result is eight flags, set as follows:

Band 7:

| | | | | | | | |
|---|---|---|---|---|---|---|---|
| x | ○ | ○ | ○ | ○ | ○ | ○ | ○ |

In an embodiment, the final output of the flag tracking process uses the flags with a TF-resolution corresponding to the time resolution of the original MDCTs (i.e., 8 tiles):

Band 6:

| | | | | | | | |
|---|---|---|---|---|---|---|---|
| x | x | ○ | ○ | ○ | ○ | ○ | ○ |

Band 7:

| | | | | | | | |
|---|---|---|---|---|---|---|---|
| x | ○ | ○ | ○ | ○ | ○ | ○ | ○ |

It is also possible for an embodiment to inject pseudorandom noise at an estimated energy level into a partition as soon as it determines that it has collapsed, instead of waiting until immediately prior to the inverse MDCTs. However, this could cause false harmonics if those partitions contribute to a linear combination of bands used to fill higher bands. It is also possible to use a different set of TF resolution changes to change the time resolution of the blocks. E.g., an embodiment could keep a band at its coded time resolution, instead of immediately converting to the time resolution of the MDCTs, and only convert to that time resolution after filling in the holes created by collapses. The rules defined for tracking flag changes apply equally well in these cases.

For purposes of the present description, the terms "component," "module," "function," and "process," may be used interchangeably to refer to a processing unit that performs a particular function and that may be implemented through computer program code (software), digital or analog circuitry, computer firmware, or any combination thereof.

It should be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

As described herein, embodiments are directed to a method and system of coding an audio signal, comprising: partitioning the audio signal into a plurality of tiles, wherein each tile comprises data from a particular segment of time and a particular set of frequencies of the audio signal; determining an energy value for each tile corresponding to a signal component in a respective tile; marking a tile as not collapsed or collapsed based on the energy value in that tile; and filling all tiles marked as collapsed with pseudorandom noise.

Embodiments are further directed to a method and system of coding an audio signal to reduce compression artifacts in an audio codec, comprising: dividing frames of the audio signal into a plurality of tiles, wherein each tile comprises data from a particular segment of time and a particular set of frequencies of the audio signal; combining or separating the tiles into tile partitions based on a variable time-frequency resolution method; determining whether or not any of the tile partitions represents a hole in a frame of the audio signal due to insufficient bits available to code a particular tile partition by examining a state of a frequency coefficient derived for the particular tile; and filling any tile partition that does not contain a non-zero frequency coefficient with pseudorandom noise.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method of coding an audio signal, comprising:

partitioning the audio signal into a plurality of tiles, wherein each tile comprises data from a particular segment of time and a particular set of frequencies of the audio signal;

determining an energy value for each tile corresponding to a signal component in a respective tile;

marking a tile as not collapsed or collapsed based on the energy value in that tile; and filling all tiles marked as collapsed with pseudorandom noise, wherein at least some of the plurality of tiles are subject to a defined change of a time-frequency resolution of each respective tile that causes to tile to increase either a time (T) resolution of the respective band or a frequency (F) resolution of the respective tile.

2. The method of claim 1 wherein the pseudorandom noise for a tile of a current frame is selected to be of an energy level that is dependent upon an energy level of a same band of the plurality of tiles in a frame prior to the current frame.

3. The method of claim 2 further comprising:

setting an feature enable bit to indicate that a collapsed tile is to be filled with pseudorandom noise; and transmitting the feature enable bit as part of the bitstream between the encoder circuit and the decoder circuit, wherein the decoder circuit fills the collapsed tile with the pseudorandom noise.

4. The method of claim 1, wherein in the case that the time-frequency resolution is changed to increase the time resolution and increase a number of tiles in a frame of the audio signal, each resulting tile is marked with the identical flag state of an original tile that the resulting tiles are derived from, such that the resulting tiles are marked as not collapsed if the original tile is marked as not collapsed, or the resulting tiles are marked as collapsed if the original tile is marked as collapsed.

5. The method of claim 1, wherein in the case that the time-frequency resolution is changed to decrease the time resolution, the resulting tile is marked as not collapsed if any original tile from which the resulting tile is formed is marked as not collapsed, and the resulting tile is marked as collapsed only if all of the original tiles from which the resulting tile is formed are marked as collapsed.

6. A method of coding an audio signal to reduce compression artifacts in an audio codec, comprising:

dividing frames of the audio signal into a plurality of tiles, wherein each tile comprises data from a particular segment of time and a particular set of frequencies of the audio signal;

combining or separating the tiles into tile partitions based on a variable time-frequency resolution method;

determining whether or not any of the tile partitions represents a hole in a frame of the audio signal due to insufficient bits available to code a particular tile partition by examining a state of a frequency coefficient derived for the particular tile; and filling any tile partition that does not contain a non-zero frequency coefficient with pseudorandom noise, wherein the pseudorandom noise for a filled tile partition of a current frame is selected to be of an energy level that is dependent upon an energy level of a same band of a frame prior to the current frame.

7. The method of claim 6 further comprising:

setting an feature enable bit to indicate that a zero frequency coefficient tile partition is to be filled with pseudorandom noise; and transmitting the feature enable bit as part of a bitstream transmitted between an encoder circuit and a decoder circuit of an audio code, wherein the decoder circuit fills the collapsed tile with the pseudorandom noise.

8. The method of claim 7 further comprising, if the feature enable bit is set:

setting a flag to indicate whether a particular tile partition is not collapsed, wherein the flag is set to a not collapsed state if the particular tile partition contains a non-zero frequency coefficient; and encoding the flag in a bitstream transmitted between an encoder circuit and a decoder circuit of the audio codec, wherein the flag comprises a single bit assigned to each tile partition of a plurality of tile partitions in the current frame.

9. The method of claim 8, wherein in the case that the time-frequency resolution is changed to increase the time resolution and increase a number of tiles in a frame of the audio signal, each resulting tile partition is marked with the identical flag state of an original tile from which the resulting tile partitions are derived.

10. The method of claim 8, wherein in the case that the time-frequency resolution is changed to decrease the time resolution, the resulting tile partition is marked as not collapsed if any original tile from which the resulting tile partition is formed is marked as not collapsed, and the resulting tile partition is marked as collapsed only if all of the original tiles from which the resulting tile partition is formed are marked as collapsed.

11. A system for coding an audio signal in an audio codec, comprising:

an input circuit receiving the audio signal;

a segmentation component partitioning the audio signal into a plurality of tiles, wherein each tile comprises data from a particular segment of time and a particular set of frequencies of the audio signal;

a band energy component determining an energy value for each tile corresponding to a signal component in a respective tile;

a flagging component marking a tile as not collapsed or collapsed based on the energy value in that tile; and a decoder flag-tracking component filling all tiles marked as collapsed with pseudorandom noise, wherein at least some of the plurality of tiles are subject to a defined change of a time-frequency resolution of each respective tile that causes to tile to increase either a time (T) resolution of the respective band or a frequency (F) resolution of the respective tile.

12. The system of claim 11 wherein the pseudorandom noise for a tile of a current frame is selected to be of an energy level that is dependent upon an energy level of a same band of the plurality of tiles in a frame prior to the current frame.

13. The system of claim 12 further comprising:

a selection component setting a feature enable bit to indicate that a collapsed tile is to be filled with pseudorandom noise; and a transmitter transmitting the feature enable bit as part of a bitstream between an encoder and a decoder, wherein the decoder fills the collapsed tile with the pseudorandom noise.

14. The system of claim 11, wherein in the case that the time-frequency resolution is changed to increase the time resolution and increase a number of tiles in a frame of the audio signal, each resulting tile is marked with the identical flag state of an original tile that the resulting tiles are derived from, such that the resulting tiles are marked as not collapsed if the original tile is marked as not collapsed, or the resulting tiles are marked as collapsed if the original tile is marked as collapsed.

15. The system of claim 11, wherein in the case that the time-frequency resolution is changed to decrease the time resolution, the resulting tile is marked as not collapsed if any original tile from which the resulting tile is formed is marked as not collapsed, and the resulting tile is marked as collapsed only if all of the original tiles from which the resulting tile is formed are marked as collapsed.

16. A system for coding an audio signal in an audio codec, comprising:

segmentation means for partitioning the audio signal into a plurality of tiles, wherein each tile comprises data from a particular segment of time and a particular set of frequencies of the audio signal;

band energy means for determining an energy value for each tile corresponding to a signal component in a respective tile;

flagging means for marking a tile as not collapsed or collapsed based on the energy value in that tile; and decoder flag-tracking means for filling all tiles marked as collapsed with pseudorandom noise, wherein at least some of the plurality of tiles are subject to a defined change of a time-frequency resolution of each respective tile that causes to tile to increase either a time (T) resolution of the respective band or a frequency (F) resolution of the respective tile.

17. The system of claim 16 wherein the pseudorandom noise for a tile of a current frame is selected to be of an energy level that is dependent upon an energy level of a same band of the plurality of tiles in a frame prior to the current frame.

18. The system of claim 17 further comprising:

a selection component setting an feature enable bit to indicate that a collapsed tile is to be filled with pseudorandom noise; and a transmitter transmitting the feature enable bit as part of a bitstream between an encoder and a decoder, wherein the decoder fills the collapsed tile with the pseudorandom noise.

19. The system of claim 16, wherein in the case that the time-frequency resolution is changed to increase the time resolution and increase a number of tiles in a frame of the audio signal, each resulting tile is marked with the identical flag state of an original tile that the resulting tiles are derived from, such that the resulting tiles are marked as not collapsed if the original tile is marked as not collapsed, or the resulting tiles are marked as collapsed if the original tile is marked as collapsed.

20. The system of claim 16, wherein in the case that the time-frequency resolution is changed to decrease the time resolution, the resulting tile is marked as not collapsed if any original tile from which the resulting tile is formed is marked as not collapsed, and the resulting tile is marked as collapsed only if all of the original tiles from which the resulting tile is formed are marked as collapsed.

* * * * *